US008726423B2

(12) United States Patent
Gu

(10) Patent No.: US 8,726,423 B2
(45) Date of Patent: May 20, 2014

(54) UNDERGARMENT, PARTICULARLY FOR MEN

(71) Applicant: Hai Gu, Novi, MI (US)

(72) Inventor: Hai Gu, Novi, MI (US)

( * ) Notice: Subject to any disclaimer, the term of this patent is extended or adjusted under 35 U.S.C. 154(b) by 0 days.

(21) Appl. No.: 13/662,911

(22) Filed: Oct. 29, 2012

(65) Prior Publication Data

US 2013/0104293 A1 May 2, 2013

Related U.S. Application Data

(60) Provisional application No. 61/551,989, filed on Oct. 27, 2011.

(51) Int. Cl.
*A41B 9/02* (2006.01)

(52) U.S. Cl.
USPC ..... 2/404

(58) Field of Classification Search
USPC ..... 2/79, 227, 228, 238, 456, 466, 465, 69, 2/400, 404, 407, 403
See application file for complete search history.

(56) References Cited

U.S. PATENT DOCUMENTS

| | | | |
|---|---|---|---|
| 2,033,551 | A | 3/1936 | Rumery |
| 2,058,970 | A | 10/1936 | Flesh |
| 2,254,863 | A | 9/1941 | Weihe |
| 2,328,953 | A | 9/1943 | Linda |
| 2,354,971 | A | 8/1944 | Wadlington |
| 2,438,310 | A | 3/1948 | Ashe |
| 2,601,602 | A | 6/1952 | Firsching, Sr. |
| 2,623,210 | A | 12/1952 | Chatfield |
| 2,624,336 | A | 1/1953 | Hansley |
| 2,641,257 | A | 6/1953 | Rutledge |
| 2,652,053 | A | 9/1953 | Dann |
| 2,684,673 | A | 7/1954 | Lerman |
| 2,872,685 | A | 2/1959 | Denbo |
| 3,207,155 | A | 9/1965 | Casey |
| 3,220,410 | A | 11/1965 | Pam |
| 3,283,545 | A | 11/1966 | Simon |
| 3,294,086 | A | 12/1966 | Nelkin |
| 3,295,520 | A | 1/1967 | Keller |
| 3,459,181 | A | 8/1969 | Mann |
| 3,499,442 | A | 3/1970 | Steinmetz |
| 3,499,443 | A | 3/1970 | Scheerer |
| 3,511,234 | A | 5/1970 | Larson |
| 3,517,666 | A | 6/1970 | Atlee |
| 3,621,846 | A | 11/1971 | Lehman |
| 3,683,909 | A | 8/1972 | Murray |
| 4,173,976 | A | 11/1979 | Bloomquist et al. |
| 4,195,630 | A | 4/1980 | Connery et al. |
| 4,377,008 | A | 3/1983 | Jung |
| 4,414,971 | A | 11/1983 | Chung |
| 4,526,167 | A | 7/1985 | Ebenal et al. |
| 4,554,685 | A | 11/1985 | Ray |
| 4,644,945 | A | 2/1987 | Thorner |
| 4,660,551 | A | 4/1987 | Nishimura |
| 4,702,239 | A | 10/1987 | Ichikawa |
| 4,759,355 | A | 7/1988 | Thrower |
| 4,870,958 | A | 10/1989 | Webster |
| 4,955,088 | A | 9/1990 | Terjesen |

(Continued)

*Primary Examiner* — Tejash Patel
(74) *Attorney, Agent, or Firm* — Gifford, Krass, Sprinkle, Anderson & Citkowski, P.C.; Douglas L. Wathen

(57) ABSTRACT

An undergarment for a man includes a waistband and a partitioning panel having an upper edge and an opposed lower edge. The upper edge is interconnected with a waistband. The partitioning panel has an opening defined therethrough. The undergarment may include a boxer style pants portion with the panel being inside the pants portion.

21 Claims, 15 Drawing Sheets

(56) References Cited

U.S. PATENT DOCUMENTS

| | | | |
|---|---|---|---|
| 4,961,419 | A | 10/1990 | Tribble et al. |
| 5,029,345 | A | 7/1991 | Angheluta et al. |
| 5,052,058 | A | 10/1991 | Mueller |
| 5,070,869 | A | 12/1991 | Zhang |
| 5,157,793 | A | 10/1992 | Michels |
| 5,226,179 | A | 7/1993 | Choi |
| 5,237,706 | A | 8/1993 | Nalbandian |
| 5,283,912 | A | 2/1994 | Chung |
| 5,379,462 | A | 1/1995 | Morgan et al. |
| 5,461,729 | A | 10/1995 | Brocks |
| 5,524,298 | A | 6/1996 | Plunkett |
| 5,547,466 | A | 8/1996 | McRoberts et al. |
| 5,598,587 | A | 2/1997 | Wada |
| 5,618,279 | A | 4/1997 | Pudlo |
| 5,647,065 | A | 7/1997 | Richerson |
| D382,386 | S | 8/1997 | Malone |
| 5,716,350 | A | 2/1998 | Ryan |
| 5,718,003 | A | 2/1998 | Gwinn |
| 5,807,299 | A | 9/1998 | McRoberts et al. |
| 5,819,323 | A | 10/1998 | Edenfield |
| 5,870,779 | A | 2/1999 | Heron |
| 5,875,495 | A | 3/1999 | Thrower |
| D408,964 | S | 5/1999 | Hernandez |
| 5,920,914 | A | 7/1999 | Dempsey |
| 5,978,971 | A | 11/1999 | Wald |
| 6,026,517 | A | 2/2000 | Kang |
| 6,038,703 | A | 3/2000 | Chung |
| 6,041,441 | A | 3/2000 | Counts et al. |
| 6,047,408 | A | 4/2000 | Brill, Jr. |
| 6,061,840 | A | 5/2000 | Alligator |
| 6,105,174 | A | 8/2000 | Nygren et al. |
| 6,243,880 | B1 | 6/2001 | Lyden |
| 6,245,036 | B1 | 6/2001 | McRoberts et al. |
| 6,289,520 | B1 | 9/2001 | Page |
| 6,295,651 | B1 | 10/2001 | Kang |
| 6,308,342 | B1 | 10/2001 | Qi |
| 6,353,940 | B1 | 3/2002 | Lyden |
| 6,425,140 | B1 | 7/2002 | Vitches |
| 6,487,728 | B1 | 12/2002 | Cook |
| 6,799,334 | B2 | 10/2004 | Yu |
| 6,820,284 | B2 | 11/2004 | Horikoshi et al. |
| 6,862,746 | B2 | 3/2005 | Cym et al. |
| 6,901,607 | B1 | 6/2005 | Elwell |
| D509,945 | S | 9/2005 | Ogle |
| 7,017,193 | B2 | 3/2006 | Auger |
| 7,024,703 | B1 | 4/2006 | Della Ratta |
| 7,065,797 | B1 | 6/2006 | Chen |
| 7,100,213 | B2 | 9/2006 | Krautbauer |
| 7,178,174 | B2 | 2/2007 | Soderstrom |
| 7,198,688 | B2 | 4/2007 | Mortell et al. |
| D566,926 | S | 4/2008 | Kang |
| D571,532 | S | 6/2008 | Gutierrez |
| 7,578,009 | B1 | 8/2009 | Boston |
| 7,631,369 | B2 | 12/2009 | Geiwald et al. |
| 7,669,253 | B2 | 3/2010 | Lin |
| 7,676,853 | B1 | 3/2010 | Cutlip |
| 7,721,355 | B2 | 5/2010 | Jin |
| 7,749,214 | B2 | 7/2010 | Hwang et al. |
| 7,762,262 | B1 | 7/2010 | Granja |
| 7,788,739 | B1 | 9/2010 | Della Ratta |
| 7,810,173 | B1 | 10/2010 | Lambeth |
| 7,895,676 | B2 | 3/2011 | Clark |
| 7,958,571 | B2 | 6/2011 | Kitsch et al. |
| 8,128,675 | B2 | 3/2012 | Nahhas |
| 2007/0283484 | A1 | 12/2007 | Wright |
| 2008/0052807 | A1 | 3/2008 | Lai |
| 2008/0189833 | A1 | 8/2008 | Jin |
| 2009/0106874 | A1 | 4/2009 | Shlush |
| 2009/0158505 | A1 | 6/2009 | Fleming et al. |
| 2010/0005561 | A1 | 1/2010 | Holland et al. |
| 2010/0275349 | A1 | 11/2010 | Wilson, II |
| 2011/0258756 | A1 | 10/2011 | Avgustopulo |
| 2011/0307996 | A1 | 12/2011 | Radford et al. |
| 2012/0017356 | A1 | 1/2012 | Baek |
| 2012/0144563 | A1 | 6/2012 | Okada |
| 2012/0151662 | A1 | 6/2012 | Gonta |
| 2012/0167280 | A1 | 7/2012 | Adams et al. |

UNDERGARMENT, PARTICULARLY FOR MEN

FIELD OF THE INVENTION

The present invention relates generally to undergarments for men.

BACKGROUND OF THE INVENTION

Traditional undergarments and pajamas for men come in multiple varieties. Undergarments and pajamas for covering the groin and genital area include briefs, which are relatively form fitting and hold the genitals against the body, and boxers that are looser. Briefs provide some genital support, but also limit the circulation of air around the genitals. Neither boxers nor briefs seek to fit material between the genitals and the groin and/or legs of the wearer.

SUMMARY OF THE INVENTION

The present invention provides several embodiments of an undergarment for a man. The undergarments include a genital partitioning panel with a genital opening defined therethrough. When the undergarment is worn, the genitals may be positioned through the opening and the panel defines a partition between the genitals and the groin or legs of the man. In some versions, the undergarment includes only a waistband and the partitioning panel, with the upper edge of the partitioning panel being attached to the waistband. In further embodiments, the undergarment includes a pair of boxer type shorts with the waistband forming part of the shorts. A pants portion is interconnected with the waistband and extends downwardly therefrom. The pants portion defines a pair of leg openings and a crotch region therebetween. The pants portion has a front section to be disposed on the front of the torso and legs of the man wearing the shorts and an opposed rear section to be disposed on the buttocks and rear of the legs of the man wearing the shorts. The front and rear sections are interconnected by the crotch region and a pair of opposed side sections. The genital partitioning panel is disposed inside the boxer type shorts and supported adjacent the front section of the pants portion.

In some versions, the partitioning panel is interconnected with the boxer type shorts only at the upper edge of the panel such that the panel hangs freely downwardly from the upper edge of the panel. In other versions, the side and lower edges of the partitioning panel define a lower perimeter and the partitioning panel is interconnected with the boxer type shorts only at the upper edge of the panel and at limited areas of the lower perimeter. The majority of the lower perimeter are not attached to the boxer type shorts, such that the panel hangs generally freely downwardly from the upper edge of the panel. The panel does not extend past the crotch region or to the rear section of the pants portion. In some versions, the majority of the lower edge of the panel is not attached to the front section of the pants portion.

The opening may have a bottom end that is U-shaped or V-shaped. In some versions, the opening may be heart-shaped. The panel may include stitching disposed between the bottom end of the opening and the lower edge of the panel, with the stitching shaping the panel below the opening such that the panel below the opening curves rearwardly. Alternatively, one or more buttons or snaps could be provided instead of the stitching. These buttons or snaps could also make the hole size adjustable.

In some versions, the panel width is less than the width of the boxer type shorts and the panel height is less than the height of the pants portion. In further versions, the panel width is greater than the panel height. The panel may be generally rectangular. The panel may be formed as the unitary piece of the textile.

DETAILED DESCRIPTION OF THE INVENTION

The present invention provides multiple designs for improved undergarments for men. Preferably, these undergarments provide a partitioning panel that, when worn by a male, is configured to dispose a layer of fabric between the genitals and the groin and/or legs of the wearer. As used herein, the term "undergarment" may mean a pair of underwear worn under other garments, or may be a standalone garment such as pajama bottoms.

Figure 1:
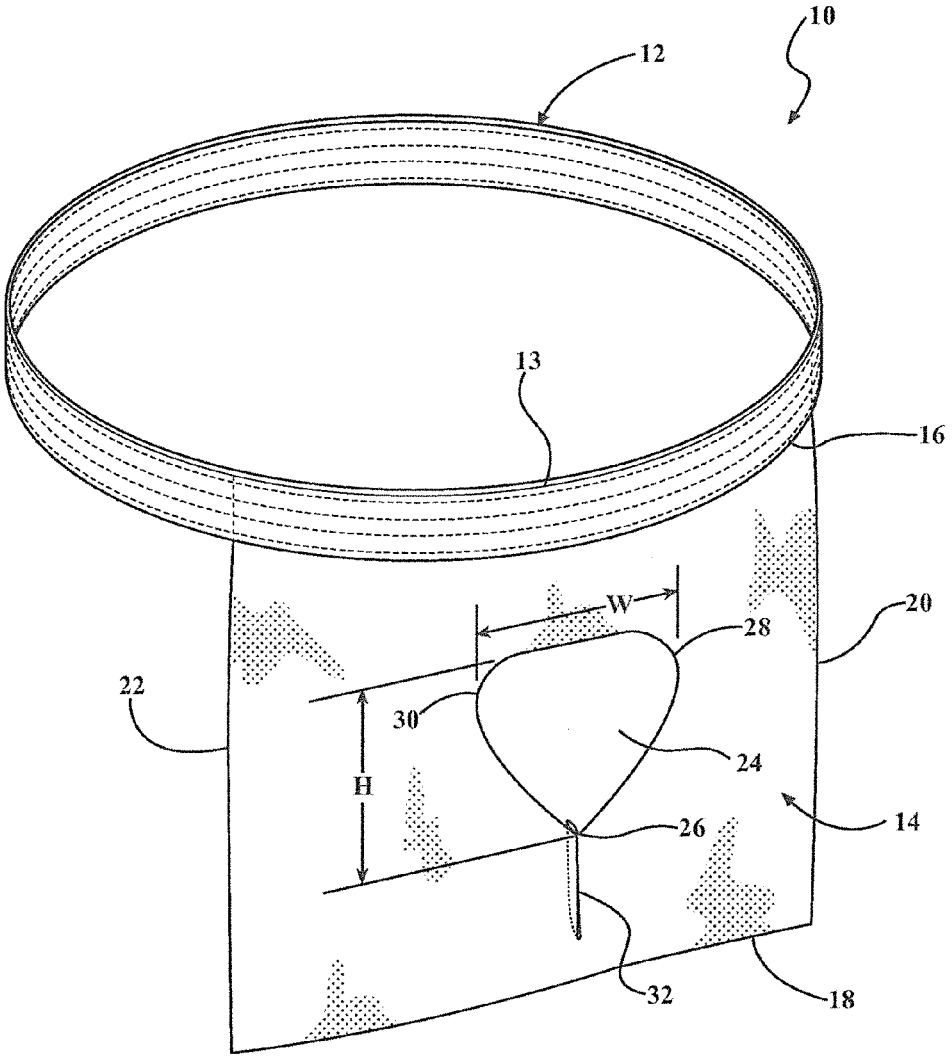
FIG. 1 is a front perspective view of a first embodiment of an undergarment in accordance with the present invention.
Figure 2:
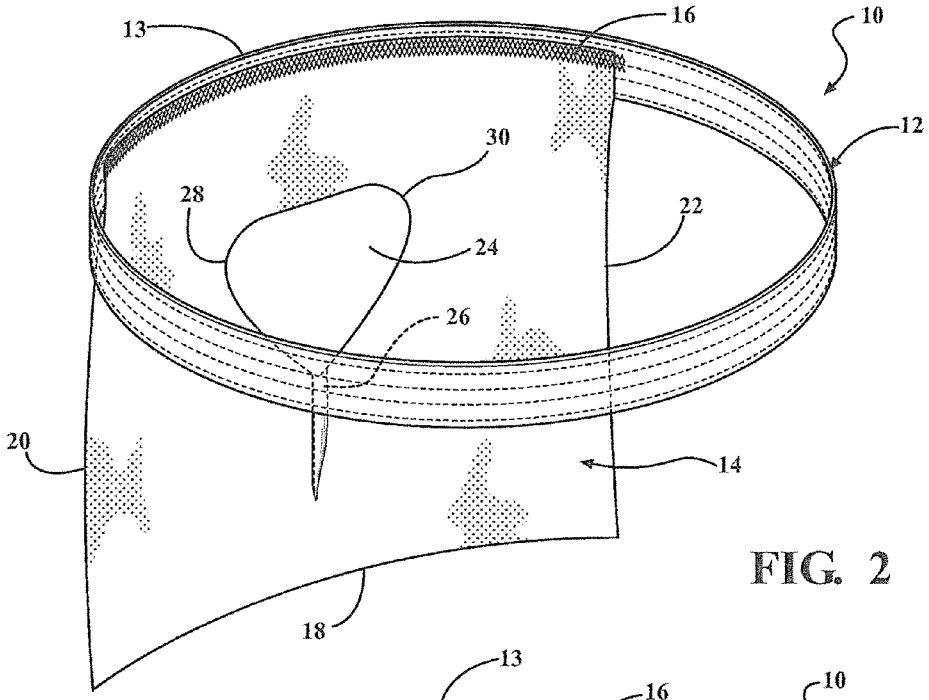
FIG. 2 is a rear perspective view of the undergarment of FIG. 1.
Figure 3:
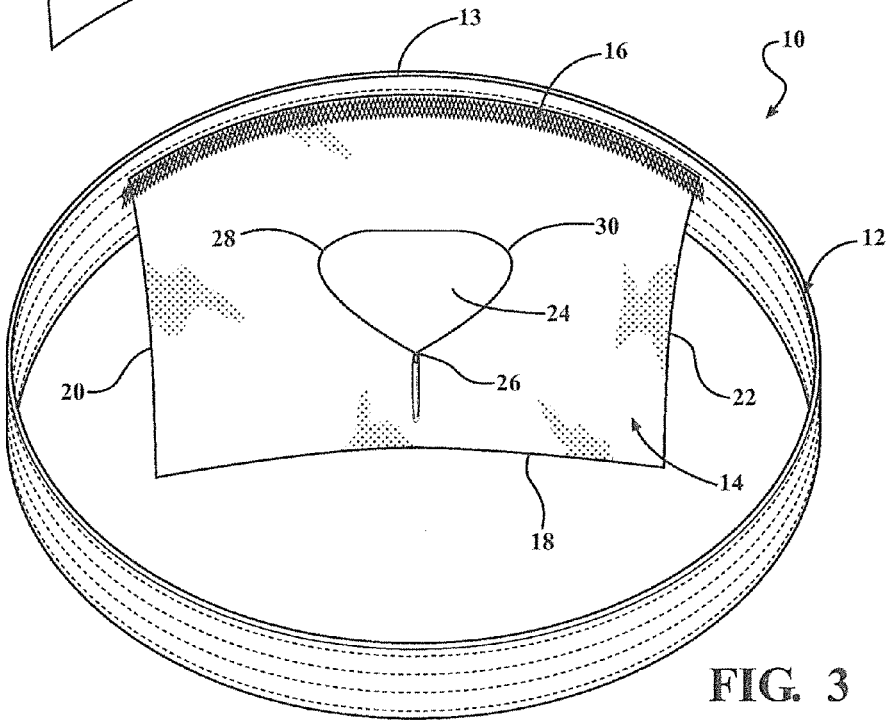
FIG. 3 is another perspective view of the undergarment of FIGS. 1 and 2.

Referring to FIGS. 1-3, a first embodiment of an improved undergarment is shown generally at 10. The undergarment has a waistband 12 that is worn on the waist of a man. The waistband 12 may be said to have a front part 13 that is disposed on the front of the waist of the man. The waistband would typically include elastic material to allow stretching when pulling on the undergarment. Alternatively, the waistband may include closures, such as snaps or buttons.

The undergarment 10 further includes a partitioning panel 14 formed of a fabric material. The partitioning panel 14 has an upper edge 16 joined to the waistband 12, such as by stitching, and an opposed lower edge 18 which is spaced downwardly from the waistband. Two side edges 20 and 22 extend between the upper and lower edges. While in the illustrated embodiment the panel 14 is generally rectangular, it may have other shapes.

The partitioning panel 14 has a genital opening 24 defined therethrough. The opening 24 is sized and positioned such that, when the waistband is on the waist of a man, the genitals may be positioned through the opening and the remainder of the panel 14 then defines a partition between the genitals and the legs.

In this embodiment, the waistband and partitioning panel together form an independent undergarment, not part of any other garment. This undergarment may be worn with other pieces of clothing, but in this embodiment it is not interconnected with other elements or garments. Further embodiments, which include further elements, will be discussed later.

The dimensions of the undergarment will vary depending on the size of the user and how the undergarment is worn. In one example, the panel has a height from the upper edge 16 to the lower edge 18 of approximately 12 inches, and a side to side width between the side edges 20 and 22 of approximately 12 inches. In other embodiments, the width is greater than the height.

Figure 4:
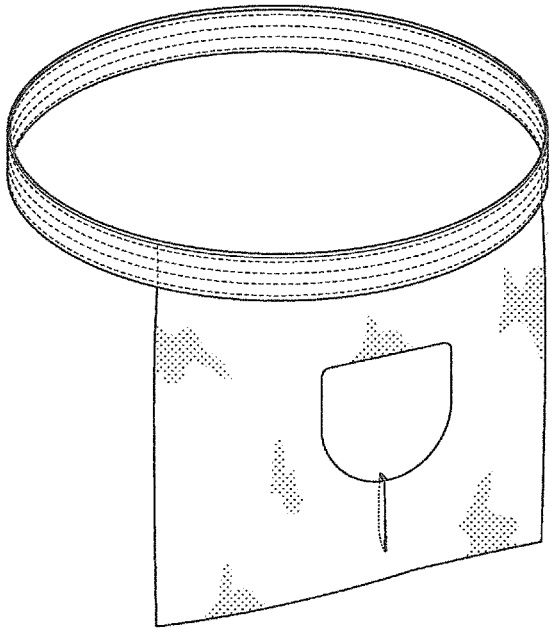
FIG. 4 is a front perspective view of an alternative version of the undergarment of FIGS. 1-3.
Figure 5:
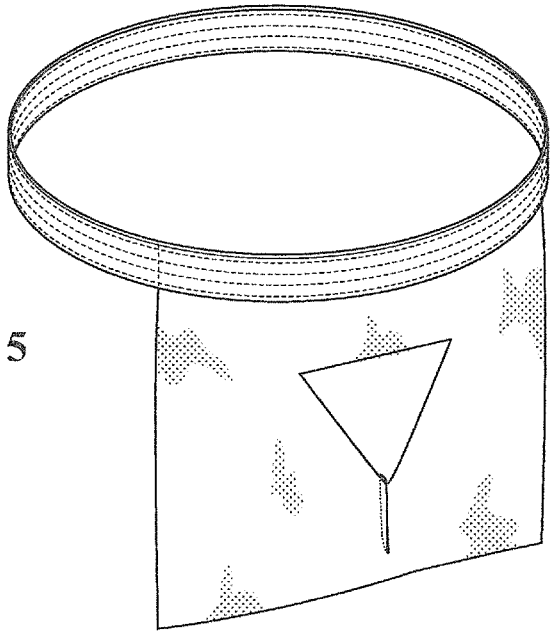
FIG. 5 is a front perspective view of a further alternative version of an undergarment.
Figure 6:
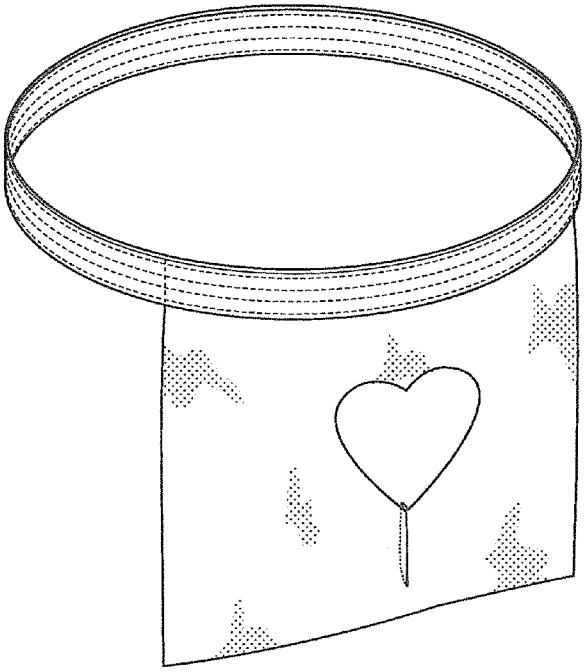
FIG. 6 is a front perspective view of yet another version of an undergarment.
Figure 7:
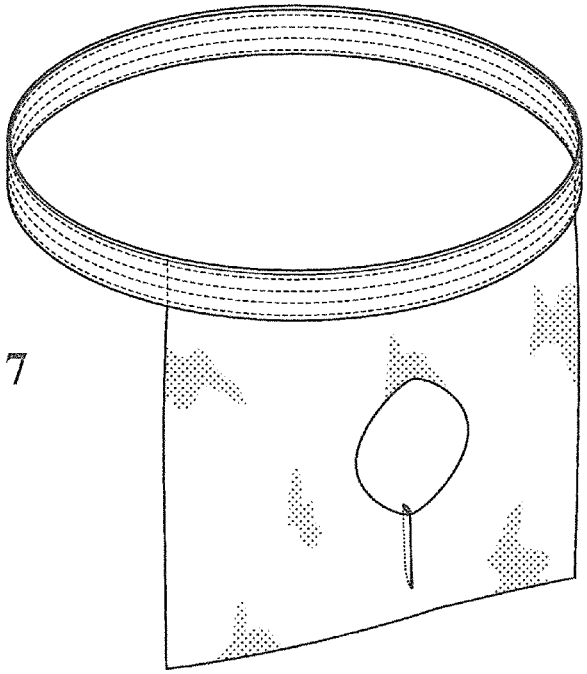
FIG. 7 is a front perspective view of a further alternative version of an undergarment.

The genital opening 24 may have a variety of shapes. In FIGS. 1-3, the opening 24 is "heart-shaped", meaning that it has a generally V-shaped bottom end 26 and is generally triangular shaped with rounded outer corners 28 and 30. The opening 24 may have a height H of approximately 3 inches and a width W of approximately 3 inches. The opening may have other shapes. FIGS. 4-7 illustrate some optional shapes. These include U-shaped with the opening extending part way or all the way to the waistband. FIG. 4 shows a U-shaped opening. FIG. 5 shows a triangle-shaped opening FIG. 6 shows a heart-shaped opening. This opening is defined herein as heart-shaped, due to the point extending downwardly from the upper edge, while the opening shown in FIG. 1 is considered "generally heart-shaped." FIG. 7 shows a football-shaped opening. Additional shapes that may be used include square, rectangular, round or oval. These alternative shapes apply to all embodiments discussed herein. Preferred embodiments have an opening with a bottom end that is V-shaped, as in FIG. 1, or U-shaped, wherein the pointed bottom end is instead rounded. FIG. 4 shows one example of an opening with a U-shaped bottom end. Most preferably, the opening is heart-shaped, as in FIG. 6, or generally heart-shaped, such as in FIG. 1, as this shape follows the shape of the anatomy where the genitals join the groin, allowing the opening to closely conform thereto.

Referring again to FIGS. 1-3, the upper edge of the opening 24 may be spaced from the upper edge 16 of the panel 14 by a distance of approximately 4 inches, in a typical example. In further examples, the panel has a height from the upper edge 16 to the lower edge 18 in the range of 2.0 inches to 22 inches, and a side to side width between the side edges 20 and 22 in the range of 2.0 inches to 22 inches. The opening 24 may have a height in the range of 0.25 inch to 7.5 inches and a width in the range of 0.25 inch to 7.5 inches. The upper edge of the opening 24 may be spaced from the upper edge 16 of the panel 14 by a distance in the range of 1.0 inches to 10.0 inches. The panel is preferably made of a soft and absorbent material, such as cotton, cotton blend materials, stretch materials and the like, polyurethane, cotton-poly blends, wool, or any natural or man-made single or blended, nylon, polyester and Lycra materials, silk, spandex, though other materials may be used.

In preferred embodiments, the partitioning panel is a unitary piece of material, rather than being stitched from multiple pieces. This reduces seams and other areas that could be uncomfortable. In some embodiments, the partitioning panel has no stitching other than at the upper edge where it is attached to the waistband. In these embodiments, the opening is merely cut out of the fabric, and does not have a stitched or bound edge. This makes the opening soft and comfortable. In further embodiments, limited stitching is provided to "shape" the panel. As shown in FIGS. 1-3, stitching 32 may be provided below the bottom end 26 of the opening 24. This stitching 32 pulls the fabric together, side to side, to cause the panel below the opening to curve rearwardly. This curvature may not be seen in the Figures, since it is a small amount. However, this curvature may be preferred in some embodiments to give the partitioning panel a shape that keeps the lower part more rearwardly when worn. In FIG. 1, the stitching 32 runs vertically and extends a distance of approximately 1.0 inch. In other embodiments, it extends for a distance in the range of 0.2 inches to 5.0 inches. In FIG. 1, the stitching 32 starts at the bottom end 26 and extends downwardly. Alternatively, the stitching may have an upper end that is a short distance below the bottom end 26. As a further alternative, the lower part of the panel may be provided with a shape in other ways. For example, the fabric itself may be formed, such as by weaving, with the desired curve. The fabric maybe selectively shrunk in the area below the opening, using a variety of approaches. Alternatively, one or more buttons or snaps could be provided instead of the stitching. These buttons or snaps could also make the hole size adjustable, by being provided at the bottom of the opening and selectively closing it.

As discussed above, the edge of the opening may be the edge of the fabric forming the panel, with no seam or binding. Alternatively, the edge may have a pleating, binding or other edge treatment. The fabric may also be formed with the opening, so that the opening does not need to be cut.

Figure 8:
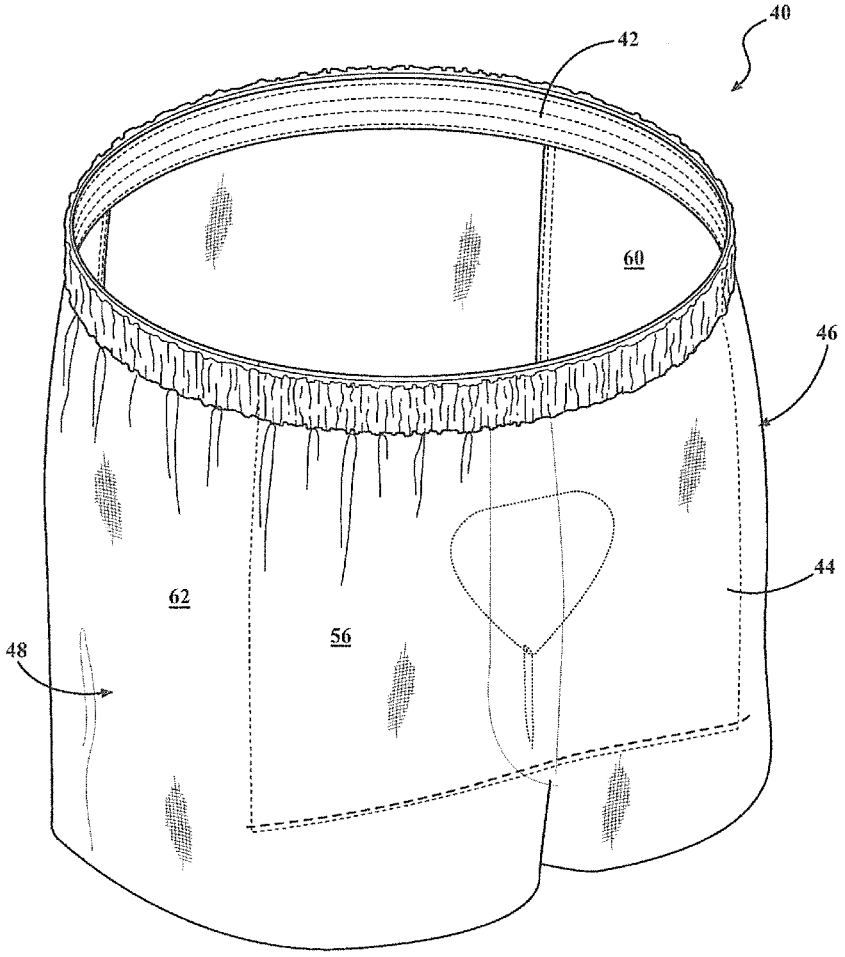
FIG. 8 is a front perspective view of a second embodiment of an undergarment in accordance with the present invention.
Figure 9:
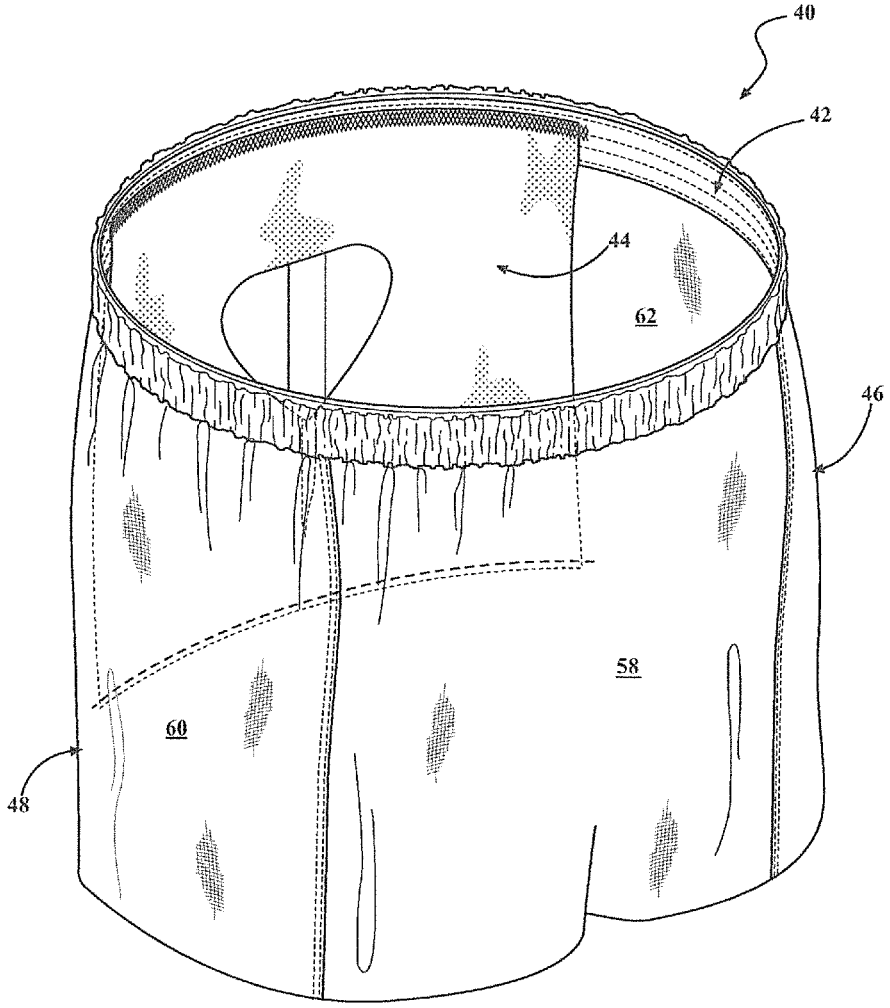
FIG. 9 is a rear perspective view of the undergarment of FIG. 8.
Figure 10:
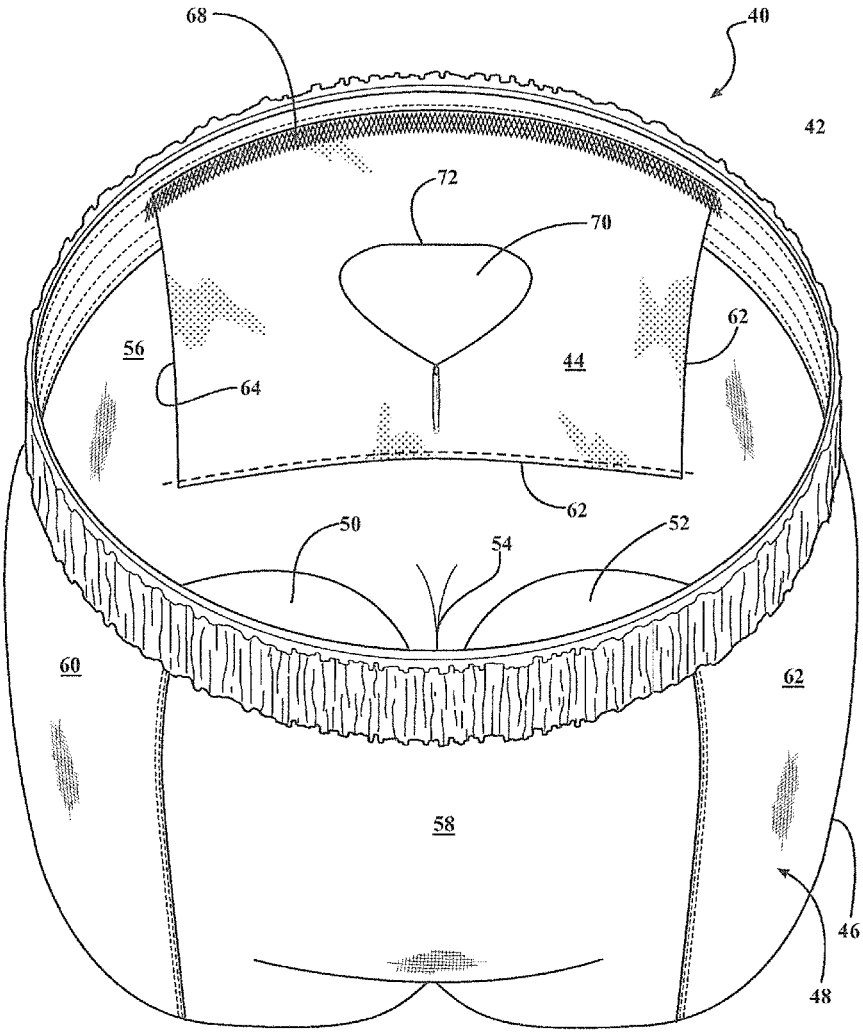
FIG. 10 is another perspective view of the undergarment of FIGS. 8 and 9.

Referring now to FIGS. 8-10, a second embodiment of an undergarment is shown generally at 40. As with the prior embodiment, the undergarment has a waistband 42 supporting a partitioning panel 44. The panel may be the same as any of the prior discussed versions. However, in this embodiment, the waistband 42 is part of a pair of boxer type shorts 46. These shorts 46 include the waistband 42 and a pants portion 48 that is interconnected with the waistband and extends downwardly therefrom. This embodiment is considered a "loose boxer" in that the pants portion is intended to fit somewhat loosely about the buttocks and legs of the wearer, unlike briefs or a tight boxer style. Preferred versions of the loose boxer do not include any tight fitting layers, such as an inner brief-like portion. The pants portion 48 defines a pair of leg openings 50 and 52 and a crotch region 54 therebetween (see FIG. 10). In alternative embodiments, the pants portion may extend farther downwardly and form a larger garment, such as pajama bottoms.

Referring to FIGS. 8-10, the pants portion 48 may be said to have a front section 56 that is disposed on the front of the torso and legs of a man wearing the shorts and an opposed rear section 58 that is disposed on the buttocks and rear of the legs of the man wearing the shorts. The front section 56 and rear section 58 is interconnected by the crotch region 54 and a pair of opposed side sections 60 and 62.

In this embodiment, the panel 44 has a lower edge 62 that is attached to the front section 56 of the pants portion 48. The lower edge 62 may be stitched to the front section 56 across the entire lower edge 62, as shown, or only in areas. As with the prior embodiment, the panel may be said to have a pair of side edges 64 and 66. Together, the side edges and the lower edge may be said to define a lower perimeter of the panel 44. In other words, the lower perimeter includes the perimeter less the upper edge 68, which is attached to the waistband 42. In this embodiment, it is preferred that the majority of the lower perimeter is not attached to the pants portion 48 or to anything else. The opening 70 may be of any of the types, sizes and shaped described for the first embodiment. The opening 70 has a perimeter 72. It should be noted that the perimeter 72 of the opening 70 is not attached to anything else, such that the opening may be spaced away from the pants portion 48 and allow free flow of air. The remainder of the panel 44 is also free of attachments, allowing it to hang generally freely and to move freely somewhat independent of the pants portion 48.

Preferrably, the panel 44 has a width less than a width of the boxer type shorts 46 and a height less than a height of the pants portion. In some versions, the panel width is greater than the height.

Figure 11:
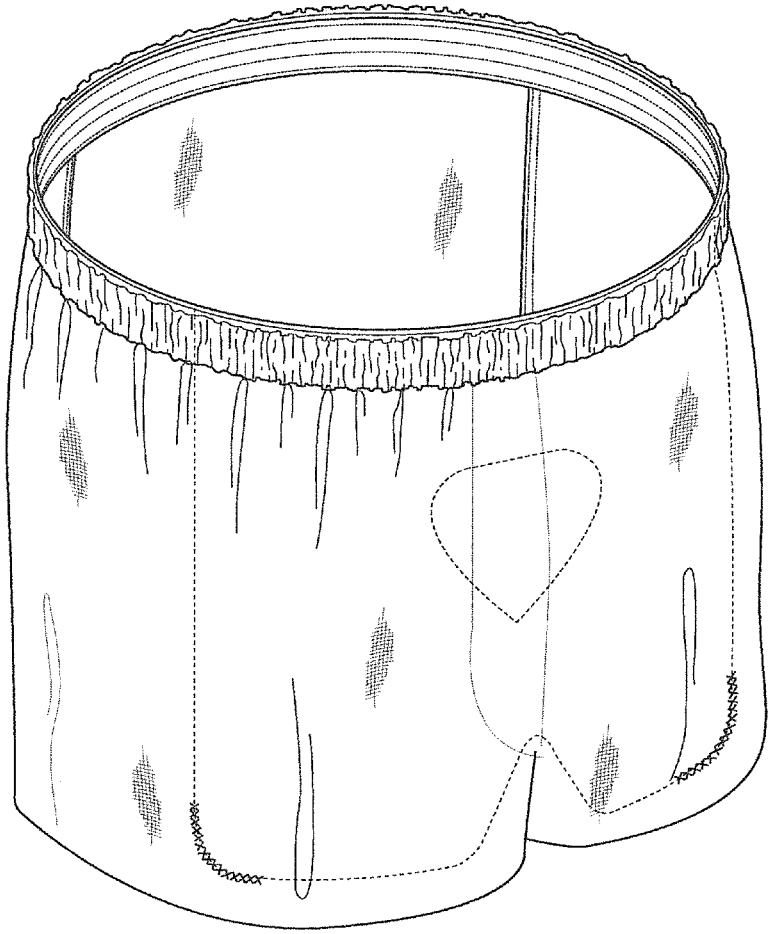
FIG. 11 is a front perspective view of an alternative version of the undergarment of FIG. 8.

Referring now to FIG. 11, an alternative version of the second embodiment is shown. In this version, the panel is longer in the areas of the leg openings and shorter above the crotch region. This shape of panel may be used with any embodiment. This version also shows stitching at the corners of the panel, attaching it to the pants portion. The stitching may be as shown, or at just the sides or bottom area of the corner. In each case, the majority of the lower perimeter is not attached to anything, including the pants portion. As a further alternative, for the panel of FIG. 11, or the version in FIGS. 8-10, the panel may be attached to the pants portion along some or all of the side edges. Preferably, again, the majority of the lower perimeter is preferably not attached, though in some versions, where the entirety of the side edges is attached, the majority of the lower perimeter is attached. Where some or all of the side edges are attached, the lower edge may be completely unattached, partially attached, or completely attached, with it being preferred that the majority of the lower perimeter is not attached.

Figure 12:
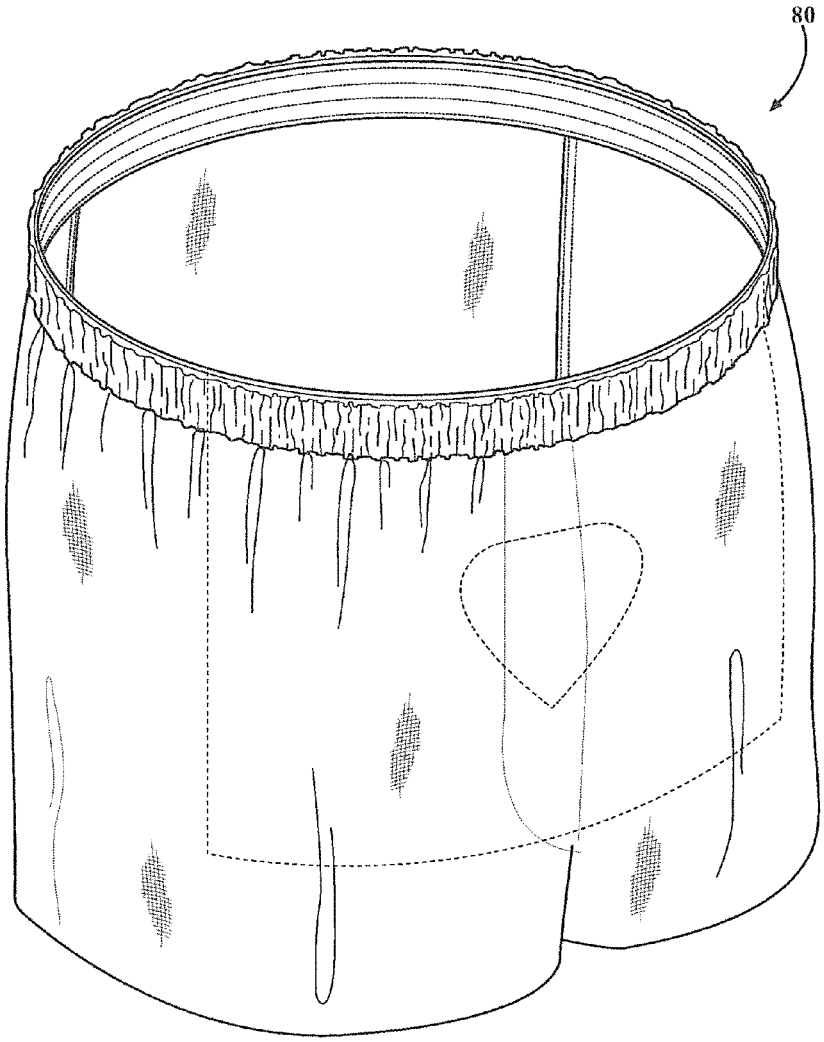
FIG. 12 is a front perspective view of a third embodiment of an undergarment in accordance with the present invention.
Figure 13:
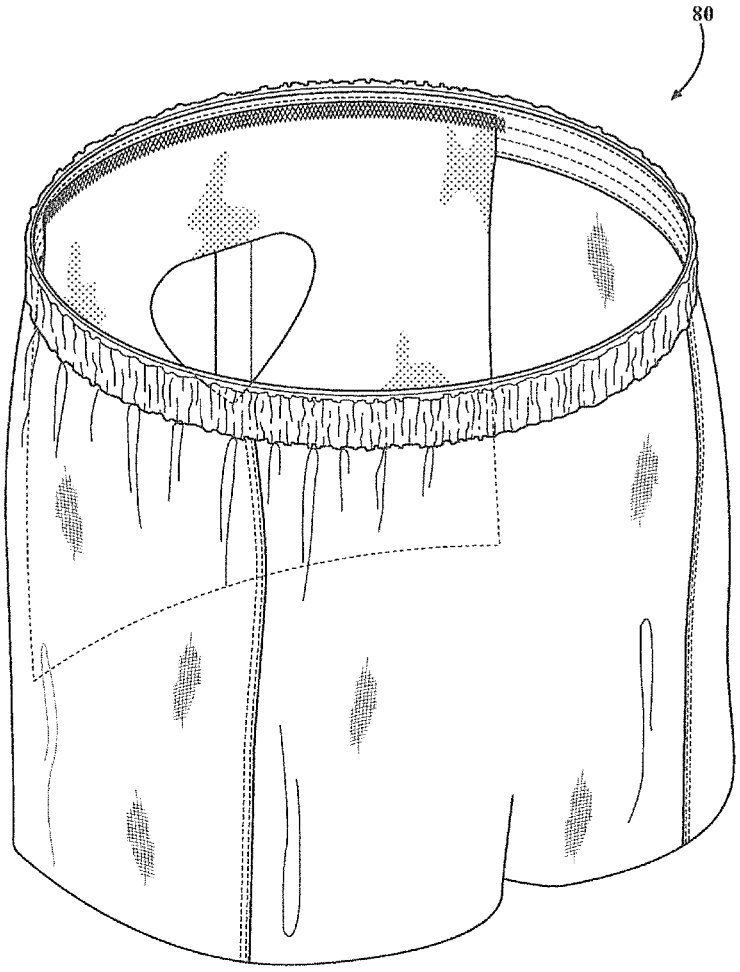
FIG. 13 is a rear perspective view of the undergarment of FIG. 12.
Figure 14:
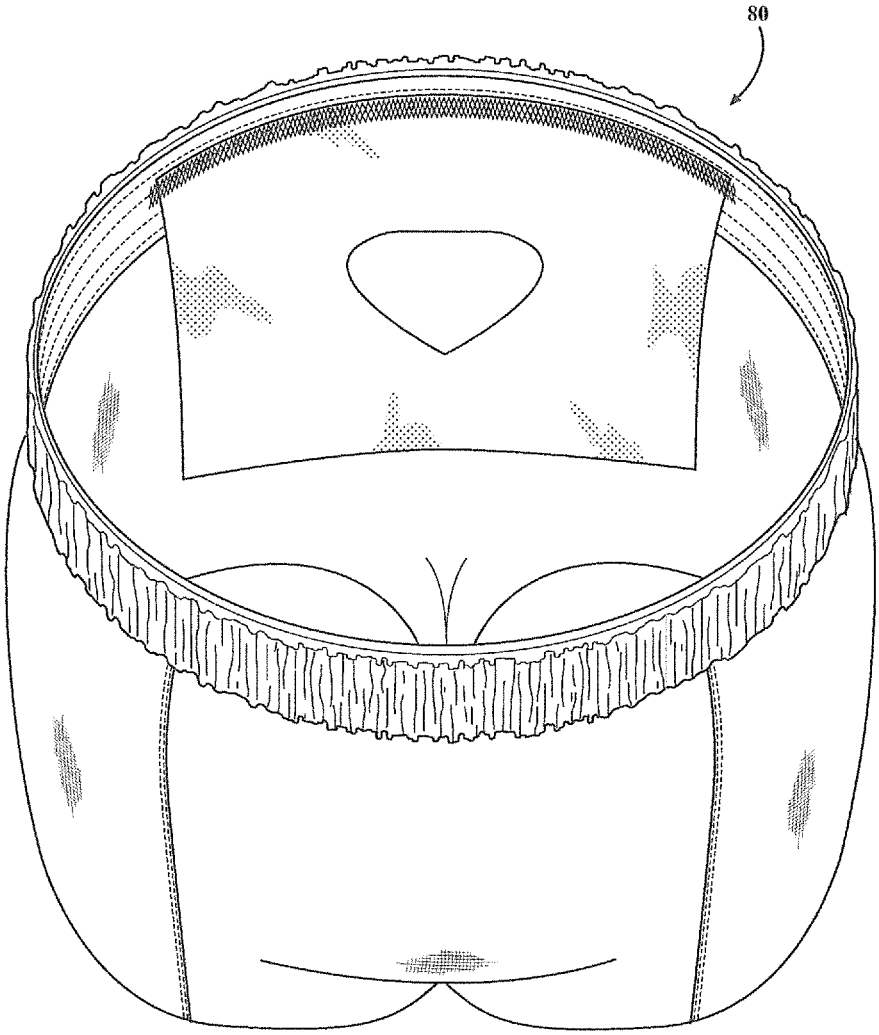
FIG. 14 is another perspective view of the undergarment of FIGS. 12 and 13.
Figure 15:
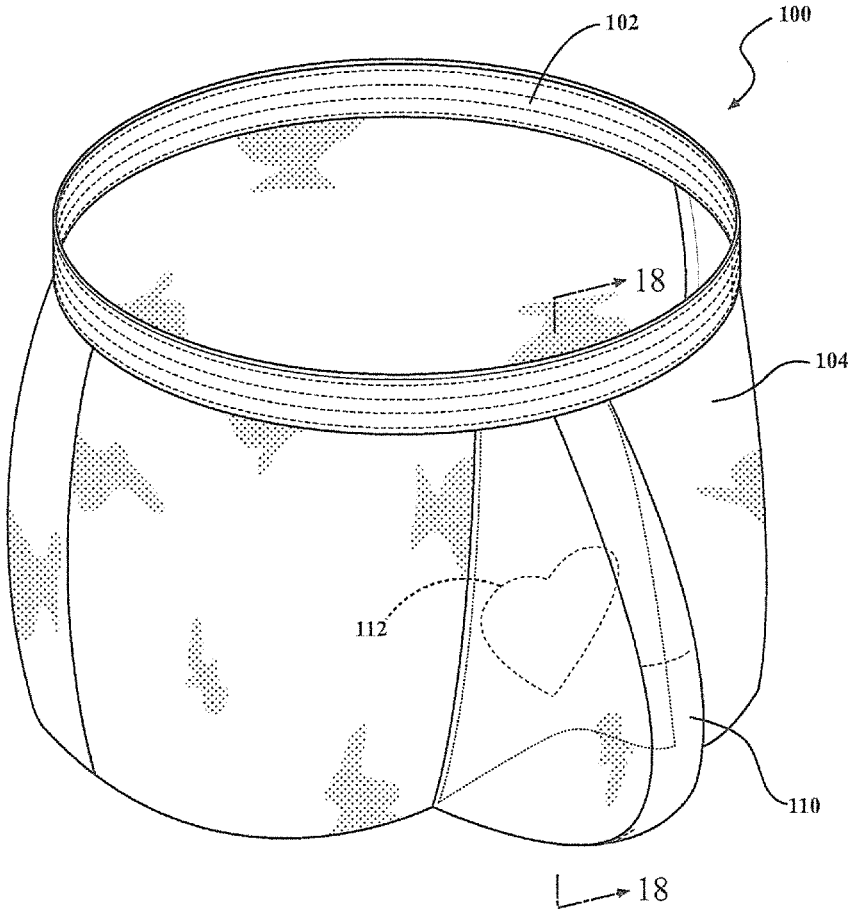
FIG. 15 is a front perspective view of the fourth embodiment of an undergarment in accordance with the present invention.
Figure 16:
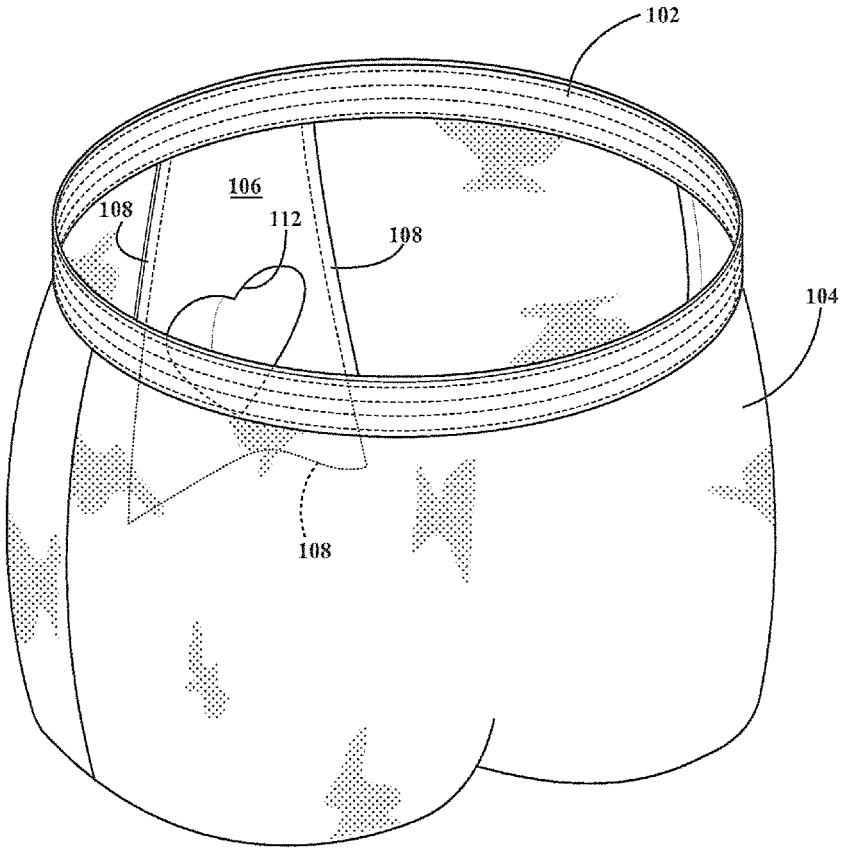
FIG. 16 is a rear perspective view of the undergarment of FIG. 15.
Figure 17:
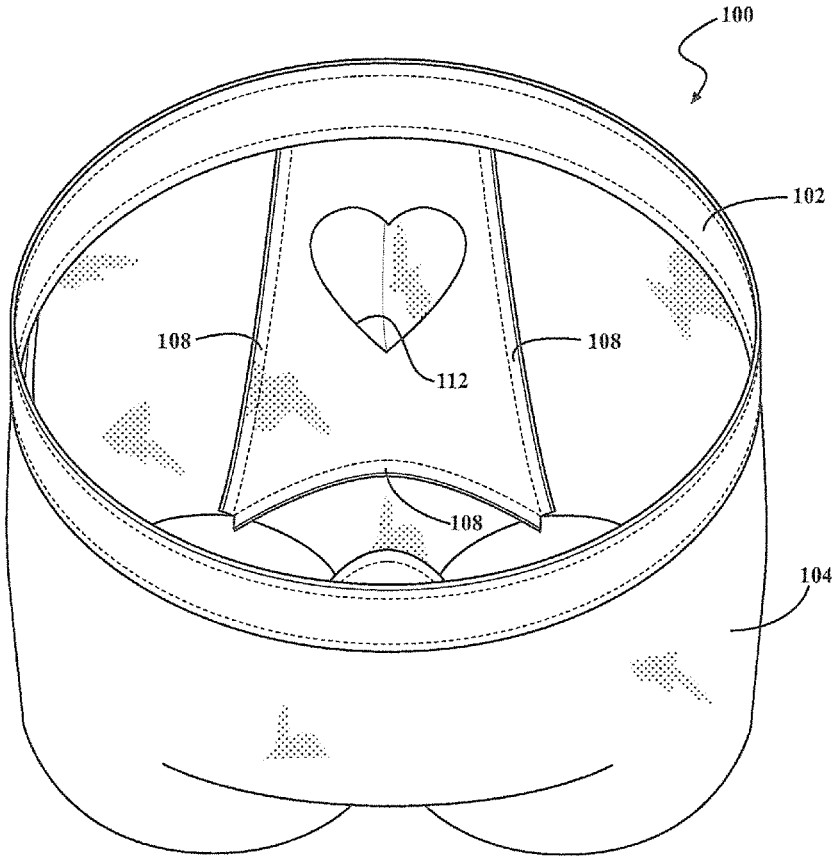
FIG. 17 is another perspective view of the undergarment of FIGS. 15 and 16.

Referring now to FIGS. 12-14, a third embodiment of the present invention is generally shown at 80. This embodiment is a loose boxer with a partitioning panel, like the embodiment of FIGS. 8-11. However, in this embodiment, the entirety of the lower perimeter of the panel is not attached to anything. The only attachment to the panel is that the upper edge is attached to the waistband. It should be noted that the attachment between the panels in the loose boxers and the waistband may be direct, such as by stitching directly to the waistband, or may be indirect, such as by stitching the panel to the front section of the pants portion, which is in-turn stitched to the waistband. Preferably, the attachment is direct, but other approaches may be used.

Referring now to FIGS. 15-18, a tight boxer embodiment of an undergarment in accordance with the present invention is generally shown at 100. In this embodiment, an inner layer is configured to fit snugly against the groin and buttocks of a wearer. A genital opening is provided in the inner layer. The opening is positioned such that when the undergarment is worn, the genitals may be positioned through the opening and the fabric surrounding the opening is disposed against the groin. The opening is preferably heart shaped. An outer pouch is interconnected with the inner layer so as to define a closed area for the genitals. Tight fitting undergarments for men at typically referred to as briefs, when they have leg openings but do not extend down the leg. They are typically referred to as boxer briefs or tight briefs if they have leg openings and extend down the leg from where the leg meets the groin. The embodiment of FIGS. 15-18 may take either form, either with or without leg portions that extend from where the leg meets the groin. In each case, they include an inner layer that is brief-shaped. The tight boxer adds the leg portions.

Figure 18:
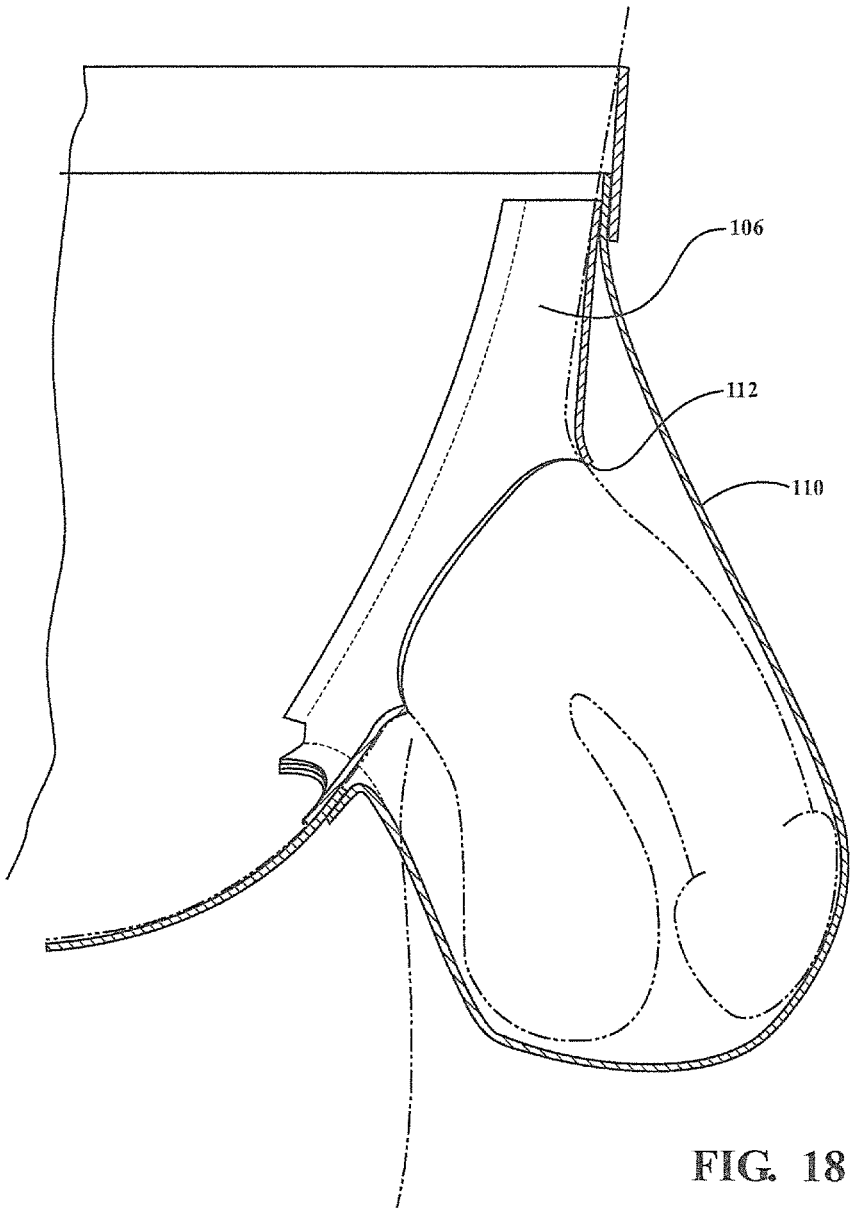
FIG. 18 is a cross-sectional view of the undergarment of FIG. 15, taken along the lines 18-18.

FIGS. 15-18 show the undergarment 100 with a waistband 102 and a downwardly extending brief-shaped pants portion 104. An inner layer is defined by parts of the pants portion 104 that would be next to the skin, along with an inner panel 106. In this embodiment, the inner panel 106 has a perimeter 108 that is joined to the pants portion. A pouch 110 is formed by the part of the pants portion external to the inner panel. As will be clear to those of skill in the art, the undergarment 100 may be constructed or stitched in a variety of ways. In an alternative version, the pants portion forms the entire inner layer, without the need for a separate inner panel. In either case, the inner layer is configured to be generally snug against the skin of a wearer. A genital opening 112 is provided in this inner layer, positioned such that when the undergarment is worn, the genitals may be positioned through the opening and reside in the pouch 110, as shown in FIG. 18. Preferably, the opening 112 is anatomically shaped, which preferably is heart shaped or generally heart shaped, as shown. The pouch 110 is configured to fit somewhat loosely around the genitals. The fabric adjacent the opening 112, and the pouch 110, cooperate to partition the genitals from the groin or legs of the wearer.

In a further alternative, the pouch may be omitted, and instead an outer cover or flap may be provided. The genitals are positioned through the opening 112 in the inner layer, and are covers by the outer cover or flap. This cover or flap may be free hanging, or may have portions of its perimeter attached to the inner layer.

The various embodiments of the present invention may be altered in various ways. As one example, the partitioning panel in some embodiments may be detachably interconnected with the waistband, such as by using hook and loop fastener material, snaps, buttons or other means. This may allow selective detachment or, in some versions, may allow for adjusting the position of the panel, side to side or up and down. These buttons or snaps may make the partitioning panel easy to be replaced without changing the boxer or pajamas.

As another alternative, especially with the embodiments of FIGS. 1-7, an additional outer panel may be provided, with the panel hanging down outside the inner partitioning panel so as to cover the front of the genitals. This may be a free hanging panel that is not attached to the partitioning panel, or some limited attachment may be provided. The outer panel may have a similar size to the partitioning panel or may have a different size and/or shape As will be clear to those of skill in the art, the herein described and illustrated embodiments of the present invention may be altered in various ways without departing from the scope or teaching of the present invention. It is the following claims, including all equivalents, which define the scope of the invention.

The invention claimed is:

1. An undergarment for a man, comprising:

a pair of boxer type shorts having a waistband forming part of the shorts, the waistband having a front part to be disposed on the front of the waist of a man, the boxer type short further having a pants portion interconnected with the waistband and extending downwardly therefrom, the pants portion defining a pair of leg openings and a crotch region therebetween;

the pants portion having a front section to be disposed on the front of the torso and legs of a man wearing the shorts and an opposed rear section to be disposed on the buttocks and rear of the legs of a man wearing the shorts, the front and rear sections being interconnected by the crotch region and a pair of opposed side sections; and a genital partitioning panel having an upper edge and an opposed lower edge separated by a panel height, the panel further having a pair of side edges extending between the upper and lower edges and being separated by a panel width, the partitioning panel being interconnected with the waistband at the upper edge of the panel, the genital partitioning panel being disposed inside the boxer type shorts and supported adjacent the front section of the pants portion; and the partitioning panel having a genital opening defined therethrough, the opening being positioned such that when the waistband is disposed on the waist of a man, the genitals may be positioned through the opening and the panel defines a partition between the genitals and the legs or groin of the man.

2. An undergarment in accordance with claim 1, wherein:

the partitioning panel is interconnected with the boxer type shorts only at the upper edge of the panel such that the panel hangs freely downwardly from the upper edge of the panel.

3. An undergarment in accordance with claim 1, wherein:

the side edges and lower edges of the partitioning panel define a lower perimeter; and the partitioning panel being interconnected with the boxer type shorts only at the upper edge of the panel and at limited areas of the lower perimeter, the majority of the lower perimeter not being attached to the boxer type shorts, such that the panel hangs generally freely downwardly from the upper edge of the panel, the panel not extending past the crotch region or to the rear section of the pants portion.

4. An undergarment in accordance with claim 3, wherein:

the majority of the lower edge of the panel is not attached to the front section of the pants portion.

5. An undergarment in accordance with claim 1, wherein:

the opening has a bottom end that is U-shaped or V-shaped.

6. An undergarment in accordance with claim 1, wherein:

the opening is heart shaped.

7. An undergarment in accordance with claim 1, wherein:

the panel has stitching disposed between the bottom end of the opening and the lower edge of the panel, the stitching shaping the panel below the opening such that the panel below the opening curves rearwardly.

8. An undergarment in accordance with claim 1, wherein:

the panel width is less than a width of the boxer type shorts and the panel height is less than a height of the pants portion.

9. An undergarment in accordance with claim 1, wherein:

the panel width is greater than the panel height.

10. An undergarment in accordance with claim 9, wherein:

the panel is generally rectangular.

11. An undergarment in accordance with claim 1, wherein:

the panel is a unitary piece of textile.

12. A garment for a man, comprising:

a pair of pajama bottoms having a waistband forming part of the pajama bottoms, the waistband having a front part to be disposed on the front of the waist of a man, the pajama bottoms further having a pants portion interconnected with the waistband and extending downwardly therefrom, the pants portion defining a pair of leg openings and a crotch region therebetween;

the pants portion having a front section to be disposed on the front of the torso and legs of a man wearing the pajama bottoms and an opposed rear section to be disposed on the buttocks and rear of the legs of a man wearing the pajama bottoms, the front and rear sections being interconnected by the crotch region and a pair of opposed side sections; and a genital partitioning panel having an upper edge and an opposed lower edge separated by a panel height, the panel further having a pair of side edges extending between the upper and lower edges and being separated by a panel width, the partitioning panel being interconnected with the waistband at the upper edge of the panel, the genital partitioning panel being disposed inside the pajama bottoms and supported adjacent the front section of the pants portion; and the partitioning panel having a genital opening defined therethrough, the opening being positioned such that when the waistband is disposed on the waist of a man, the genitals may be positioned through the opening and the panel defines a partition between the genitals and the legs or groin of the man.

13. A garment in accordance with claim 12, wherein:

the partitioning panel is interconnected with the pajama bottoms only at the upper edge of the panel such that the panel hangs freely downwardly from the upper edge of the panel.

14. A garment in accordance with claim 12, wherein:

the side edges and lower edges of the partitioning panel define a lower perimeter; and the partitioning panel being interconnected with the boxer type shorts only at the upper edge of the panel and at limited areas of the lower perimeter, the majority of the lower perimeter not being attached to the boxer type shorts, such that the panel hangs generally freely downwardly from the upper edge of the panel, the panel not extending past the crotch region or to the rear section of the pants portion.

15. A garment in accordance with claim 14, wherein:

the majority of the lower edge of the panel is not attached to the front section of the pants portion.

16. A garment in accordance with claim 12, wherein:

the opening has a bottom end that is U-shaped or V-shaped.

17. A garment in accordance with claim 12, wherein:

the opening is heart shaped.

18. A garment in accordance with claim 12, wherein:

the panel has stitching disposed between the bottom end of the opening and the lower edge of the panel, the stitching shaping the panel below the opening such that the panel below the opening curves rearwardly.

19. A garment in accordance with claim 12, wherein:

the panel width is greater than the panel height.

20. A garment in accordance with claim 19, wherein:

the panel is generally rectangular.

21. A garment in accordance with claim 12, wherein:

the panel is a unitary piece of textile.

* * * * *